US006719220B2

(12) United States Patent
Hohl

(10) Patent No.: US 6,719,220 B2
(45) Date of Patent: Apr. 13, 2004

(54) FUEL INJECTION VALVE

(75) Inventor: Guenther Hohl, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/168,264

(22) PCT Filed: Oct. 17, 2001

(86) PCT No.: PCT/DE01/03967

§ 371 (c)(1),
(2), (4) Date: Oct. 11, 2002

(87) PCT Pub. No.: WO02/33249

PCT Pub. Date: Apr. 25, 2002

(65) Prior Publication Data

US 2003/0071148 A1 Apr. 17, 2003

(30) Foreign Application Priority Data

Oct. 19, 2000 (DE) ..... 100 51 900

(51) Int. Cl.[7] ..... F02M 61/10

(52) U.S. Cl. ..... 239/533.11; 239/590; 239/590.3; 239/533.2; 239/482; 239/585.4; 239/453

(58) Field of Search ..... 239/533.2, 533.12, 239/533.11, 590, 590.3, 596, 466, 467, 482, 453, 491, 494, 496, 497, 585.4, DIG. 19; 251/129.14, 129.16, 129.21

(56) References Cited

U.S. PATENT DOCUMENTS

| | | | | |
|---|---|---|---|---|
| 3,703,184 A | | 11/1972 | Messerschmidt | |
| 4,197,997 A | * | 4/1980 | Wu et al. | 239/453 |
| 4,958,771 A | * | 9/1990 | Klomp | 239/453 |
| 5,020,728 A | * | 6/1991 | Linder et al. | 239/533.12 |
| 6,168,098 B1 | * | 1/2001 | Brinn, Jr. | 239/585.4 |

FOREIGN PATENT DOCUMENTS

| | | |
|---|---|---|
| DE | 10 90 031 | 9/1960 |
| DE | 36 43 523 | 6/1988 |
| DE | 196 25 059 | 1/1998 |
| GB | 1 212 443 | 11/1970 |

* cited by examiner

*Primary Examiner*—Dinh Q. Nguyen
(74) *Attorney, Agent, or Firm*—Kenyon & Kenyon

(57) ABSTRACT

A fuel injector, especially for the direct injection of fuel into the combustion chamber of a mixture-compressing internal combustion engine having externally supplied ignition, comprising a swirl disk having swirl channels and a central recess, and having a guide compensator inserted into the recess whose center axis is able to be inclined relative to the center axis of the fuel injector and which has a sealing fit with respect to the valve needle. Formed by a sealing-seat surface, disposed in the swirl disk, and a radial widening of the guide compensator is a sealing seat which tolerates an excursion of the center axis, preventing a swirl-free leakage flow in the same manner as the sealing fit between the valve needle and the guide compensator.

8 Claims, 2 Drawing Sheets

FUEL INJECTION VALVE

FIELD OF THE INVENTION

The present invention relates to a fuel injector.

BACKGROUND INFORMATION

Fuel injectors having a component part for guiding a valve needle described in German Patent Application No. DE 36 43 523. They include a swirl disk disposed upstream from the valve-sealing seat, which has a central guide bore. Swirl channels, connecting the fuel-pressurized chamber, which is located upstream from the swirl disk, to a swirl chamber adjoining in the flow direction, guide the flow. When the valve is open, the fuel flows from the swirl channels into the swirl chamber, the velocity vector having a component in the circumferential direction. The central bore of the swirl disk guides the valve-closure member, or the valve needle. The swirl disk concentrically adjusts itself by a conical seat surface in the area of the valve seat, where it is sealingly held due to the throttling of the fuel flow. To prevent a secondary flow path for the fuel along the guide bore, the opening in the swirl disk is narrowly toleranced in relation to the valve needle and the valve-closure member.

Moreover, German Patent Application No. DE 196 25 059 describes a fuel injector where the guide of the valve needle, or the valve-closure member, is disposed in a subassembly upstream from the valve seat. As in DE 36 43 523, a secondary flow path is prevented by a small gap dimension between the guide bore and valve needle, or valve-closure member. A swirl is generated by bores, which have a tangential component and discharge upstream from the valve-sealing seat. The valve needle is guided in a sleeve which, in turn, is centered in the valve seat by a downstream conical form. In a further exemplary embodiment, the valve-seat member and the guide are designed as one piece.

Disadvantageous in these fuel injectors is the high degree of precision required in the manufacture of the valve's component parts. The swirl formation is highly dependent on the flow-through of the swirl channels. If a secondary flow path is present for the fuel, this will result in a flow portion lacking circumferential speed, which negatively affects the swirl generation and, consequently, the fuel atomization. In the final analysis, the combustion will be less efficient. Due to the manufacturing process, the dimensions of the component parts are tolerance-encumbered. This may cause an angle error of the valve needle, or the valve-closure member, in the area of the valve-seat. In the afore-mentioned fuel injectors, the valve needle, or the valve-closure member, is guided by a component part which is centered in the nozzle body either in a form-locking or force-locking manner. Thus, the orientation of the guide bore relative to the position of the valve needle, or the valve-closure member, cannot be adjusted. It is only possible to compensate for the positional deviation by enlarging the guide bore. This also enlarges the secondary flow path, which will change the metered fuel quantity and the spray-off pattern. Expensive production methods are used to meet the high demands of a precise spray-off pattern and the metered fuel quantity, in this way ensuring an exact finishing and installation of all relevant component parts with respect to their position relative to the center axis of the fuel injector.

SUMMARY

A fuel injector according to the present invention may have the advantage over that the center axis of the valve needle may be inclined relative to the center axis of the fuel injector, without this requiring a modification of the fit between the valve needle, or valve-seat member, and the guiding bore. The use of two component parts, which are flexibly supported inside each other, makes it possible to incline a guide compensator together with the valve needle. The guide compensator and the valve needle remain in correct positional alignment, thereby improving the sealing fit between both component parts. The angle compensation between the valve needle and the center axis of the fuel injector is achieved by a sealing seat being formed between the guide compensator and a swirl disk, the sealing seat being flexible with respect to the angle between the center axes of the swirl disk and the guide compensator. As a result, the entire fuel flow reaching the spray-off orifice flows through the swirl channels, allowing a defined swirl generation and precise metering of a fuel quantity to be sprayed off.

It is advantageous in this context that the swirl disk may be manufactured together with the guide compensator and a spring as a sub-assembly. In the further installation process, the entire subassembly can then be treated as a single component.

Also advantageous is the common center point of the spherical sealing surface of the guide compensator and the spherical valve-closure member in the rest state of the fuel injector. The position of the valve-closure member is clearly defined by the valve-seat member. An angle error, therefore, will merely result in a rotation about the center point of the spherical valve-closure member. A rotation about the common center point will not affect the sealing contact of both sealing seats.

BRIEF DESCRIPTION OF THE DRAWINGS

An exemplary embodiment of the present invention is represented in simplified form in the drawing and elucidated in more detail in the following description.

DETAILED DESCRIPTION

Figure 1:
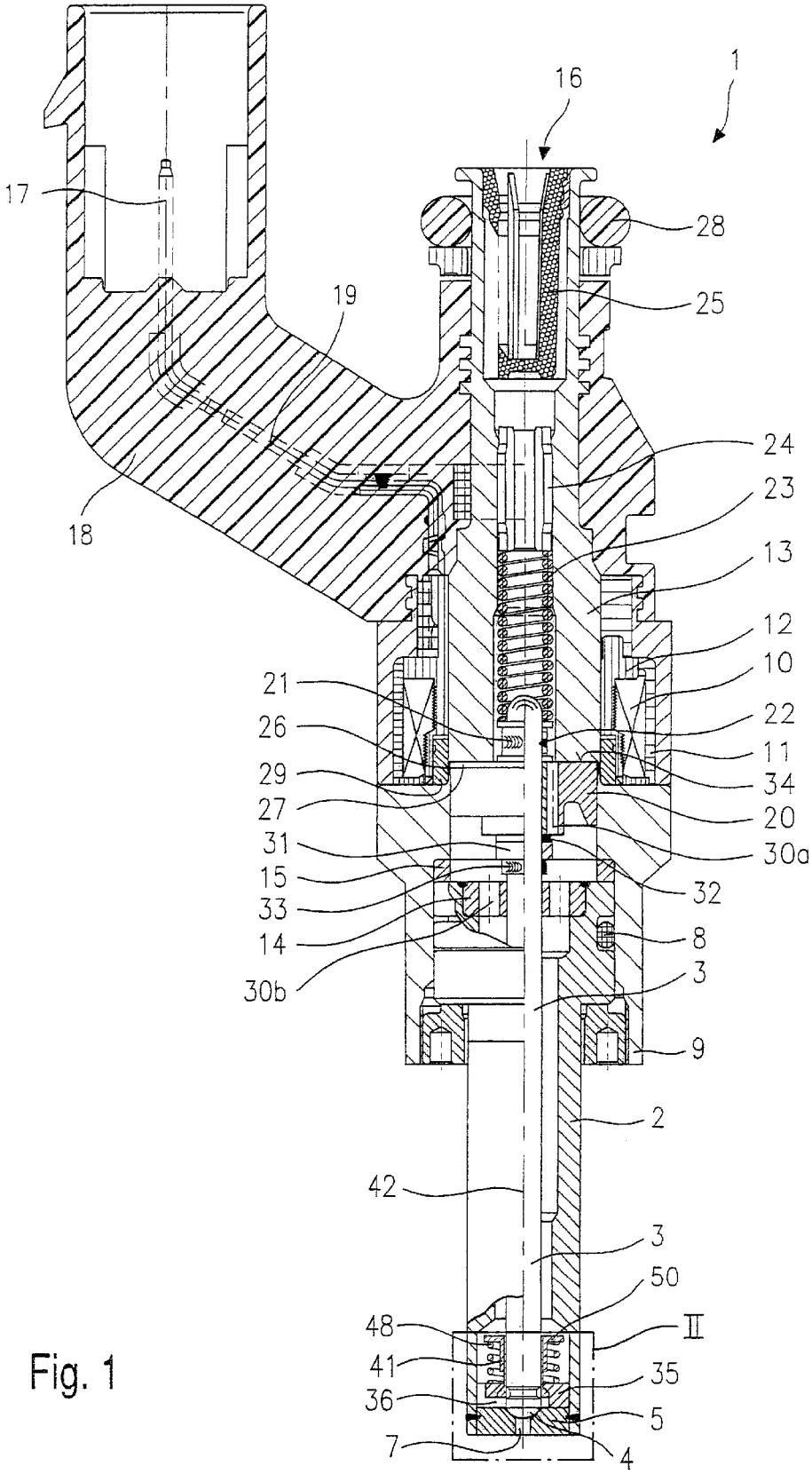
FIG. 1 shows a schematic partial section through an example fuel injector according to the present invention.
Figure 2:
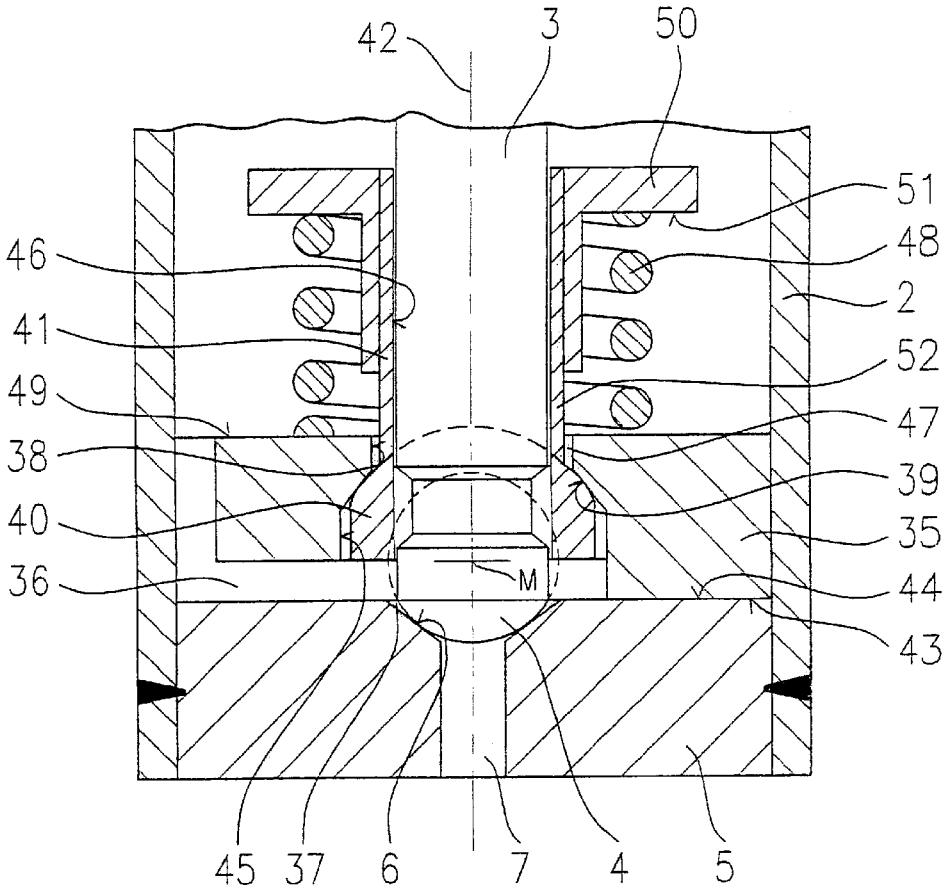
FIG. 2 shows a schematic section of a detail II of FIG. 1 through an exemplary embodiment of a fuel injector according to the present invention.

Before an exemplary embodiment of a fuel injector 1 according to the present invention or of a swirl disk 35 including a guide compensator 41 is described more precisely with reference to FIG. 2, to better understand the present invention, fuel injector 1 shall first of all be briefly explained in an overall representation with respect to its important components, with the aid of FIG. 1.

Fuel injector 1 is in the form of a fuel injector for fuel-injection systems of mixture-compressing internal combustion engines having external ignition. Fuel injector 1 is particularly suitable for direct fuel injection into a combustion chamber (not shown) of an internal combustion engine.

Fuel injector 1 is made up of a nozzle body 2 in which a valve needle 3 is located. Valve needle 3 is in operative connection with a valve-closure member 4 which cooperatives with a valve-seat surface 6 disposed on a valve-seat member 5 to form a first sealing seat. In the exemplary embodiment, fuel injector 1 is an inwardly-opening, electromagnetically actuable fuel injector 1 which is provided with a spray-off orifice 7. Nozzle body 2 is sealed from external pole 9 of a magnetic coil 10 by a gasket 8. Magnetic coil 10 is encapsulated in a coil housing 11 and wound on a bobbin 12, which lies adjacent to an internal pole 13 of magnetic coil 10. Internal pole 13 and external pole 9 are separated from each other by a gap 26 and are supported on a connecting component 29. Magnetic coil 10 is energized via an electric line 19 by an electric current, which can be supplied via an electrical plug-in contact 17. A plastic jacket 18, which may be sprayed onto internal pole 13, encloses plug-in contact 17.

Valve needle 3 is guided in a valve needle guide 14, which is designed as a disk. A paired adjustment disk 15 adjusts the lift. On the other side of adjustment disk 15 is an armature 20. It is in friction-locked connection with valve needle 3 via a first flange 21, valve needle 3 being connected to first flange 21 by a welded seam 22. Supported on first flange 21 is a restoring spring 23 which, in the present design of fuel injector 1, is prestressed by a sleeve 24.

A second flange 31, which is connected to valve needle 3 via a welded seam 33 as well, is used as lower armature stop. An elastic intermediate ring 32 resting on second flange 31 prevents rebounding when fuel injector 1 is closed.

Running in valve needle guide 14, armature 20 and swirl disk 35 are fuel channels 30*a*, 30*b* and swirl channels 36, respectively, which conduct the fuel, supplied via central fuel feed 16 and filtered by a filter element 25, to spray-discharge orifice 7 in valve-seat member 5. Fuel injector 1 is sealed from a distributor line (not shown) by a gasket 28.

In the rest state of fuel injector 1, restoring spring 23, via first flange 21 at valve needle 3, acts upon armature 20 counter to its lift direction in such a way that valve-closure member 4 is held in sealing contact against valve-seat surface 6. Upon excitation of magnetic coil 10, it generates a magnetic field which moves armature 20 in the lift direction, counter to the spring force of restoring spring 23, the lift being specified by a working gap 27 located between internal pole 13 and armature 20 in the rest position. Armature 20 also carries along in the lift direction first flange 21, which is welded to valve needle 3, and thus valve needle 3. Valve-closure member 4, being operatively connected to valve needle 3, lifts off from valve seat surface 6 and fuel, guided to spray-off orifice 7 via fuel channels 30*a*, 30*b* and swirl channels 36, respectively, is sprayed off.

When the coil current is turned off, armature 20 falls away from internal pole 13 once the magnetic field has decayed sufficiently, due to the pressure of restoring spring 23 on first flange 21, whereupon valve-needle 3 moves in a direction counter to the lift. As a result, valve-closure member 4 comes to rest on valve-seat surface 6, and fuel injector 1 is closed.

The example embodiment of a fuel injector 1 according to the present invention includes a swirl disk 35 which has a sealing-seat surface 39 integrated into its central recess 38 which cooperates with a radial widening 40 of a guide compensator 41 at the downstream end to form a second sealing seat, allowing an excursion of the center axis of valve needle 3 relative to the center axis of fuel injector 1.

As shown in FIG. 2, swirl disk 35 is provided with swirl channels 36 to guide the fuel flow, which are introduced, for instance, as recesses into the downstream side 43 of swirl disk 35 and are closed by upstream side 44 of valve-seat member 5 to form swirl channels 36. In order to generate swirl, swirl channels 36 discharge with a tangential component into a swirl chamber 37 upstream from valve-seat surface 6. Furthermore, swirl disk 35 has a central, traversing recess 38, which has a radial widening 45 downstream and is penetrated by valve needle 3 and guide compensator 41. Disposed in widening 45 is a sealing-seat surface 39 pointing downstream.

Guide compensator 41 also has a central recess 46 which, relative to the radial extension of valve needle 3, is tolerance d such that a valve needle 3 may easily move in the axial direction, yet no leakage flow can form along the fit. At its downstream end, guide compensator 41 has a radial widening 40 whose radial dimensions are larger than the smallest radial extension of recess 38 in swirl disk 35. Upstream from radial widening 40, guide compensator 41 is formed in the shape of a sleeve, and the radial extension of guide compensator 41 is smaller than recess 38 of swirl disk 35, so that guide compensator 41 is able to be inserted into swirl disk 35, counter to the flow direction, until sealing-seat surface 39 of swirl disk 35 and radial widening 40 of guide compensator 41 are in sealing contact with each other. Located between sleeve-shaped region 52 of guide compensator 41 and central recess 38 of swirl disk 35 is a gap 47, which allows an excursion of the center axis of guide compensator 41 relative to the center axis of fuel injector 1.

Like radial widening 40 of guide compensator 41, valve-closure member 4 also has a, for example, spherical form in the region of the respective sealing-seat surface. When fuel injector 1 is in the rest state, the two center points m of the sphere geometries are identical. Due to the sphere geometry, valve-closure member 4 as well as guide compensator 41 remain in sealing contact when an angle is formed between the center axes of fuel injector 1 and valve needle 3.

To obtain a sealing surface pressure between radial widening 40 of guide compensator 41 and sealing-seat surface 39, swirl disk 35 and guide compensator 41 are braced by a spring 48, for instance. FIG. 2 shows an exemplary embodiment with a pressurized spring 48, which is supported on upstream side 49 of swirl disk 35. Disposed at the upstream end of guide compensator 41 is a flange 50 with a collar-shaped outer bearing 51 for spring 48, which is connected to guide compensator 41 in a (not further depicted) manner. The radial dimension of collar-shaped outer bearing 51 is less than the inner diameter of nozzle body 2, so that an excursion of the center axis of guide compensator 41 is not restricted by contact with outer bearing 51 and nozzle body 2. Furthermore, fuel is able to flow past outer bearing 51 to swirl channels 36 in swirl disk 35, without outer bearing 51 requiring through-holes. To form collar-shaped outer bearing 51, guide compensator 41, in place of flange 50, may be widened in one piece at the upstream side.

It is also possible to use a spring under tensile strength, mounted between guide compensator 41 and nozzle body 2, to support guide compensator 41 on swirl disk 35.

With respect to its guiding and sealing tasks, guide compensator 41 may be implemented with valve-closure member 4 instead of valve needle 3 as the corresponding assembly.

What is claimed is:

1. A fuel injector for fuel-injection systems of internal combustion engines, comprising:

a valve-seat member including a valve-seat surface and a valve-closure member configured to cooperate with the valve-seat surface to form a first sealing seat;

a swirl disk including a central recess, the valve-closure member penetrating the recess;

a sealing seat surface arranged adjacent to the swirl disk;

a valve needle connected to the valve-closure member and including at least one swirl channel arranged upstream from the valve-seat surface, the swirl channel configured to generate a swirl in a fuel to be sprayed off by the fuel injector; and a guide compensator insertable into the central recess of the swirl disk, the guide compensator including a central recess to guide the valve needle, and a radial widening at a downstream end of the guide compensator which cooperates with the sealing-seat surface to form a second sealing seat.

2. The fuel injector according to claim 1, wherein the radial widening has a spherical geometry in an area of the sealing-seat surface.

3. The fuel injector according to claim 2, wherein the valve-closure member has a spherical geometry in an area of the valve-seat surface.

4. The fuel injector according to claim 3, wherein in a rest position of the fuel injector, a center point of the spherical geometry of the radial widening, in an area of the sealing-seat surface, is identical to a center point of the spherical geometry of the valve-closure member.

5. The fuel injector according to claim 1, wherein a radial extension of the central recess of the swirl disk is greater than a radial extension of the guide compensator upstream from the radial widening, wherein a center axis of the guide compensator is configured to incline relative to a center axis of the swirl disk.

6. The fuel injector according to claim 1, further comprising:

a spring holding the radial widening of the guide compensator in sealing contact with the sealing-seat surface.

7. The fuel injector according to claim 6, wherein the spring rests on an upstream side of the swirl disk.

8. The fuel injector according to claim 6, wherein the guide compensator includes a flange having a collar-shaped outer bearing to receive the spring.

* * * * *